United States Patent [19]

Bachmann et al.

[11] Patent Number: 4,599,881

[45] Date of Patent: Jul. 15, 1986

[54] METHOD AND ARRANGEMENT FOR WINDING AND FORMING HELIXES OF ELASTIC PLASTIC OR METAL WIRE

[75] Inventors: Wolfgang Bachmann, Dreieich; Dieter Spahn, Hanau; Lothar Nuss, Offenbach, all of Fed. Rep. of Germany

[73] Assignee: Roda Holding Anstalt, Vaduz, Liechtenstein

[21] Appl. No.: 602,413

[22] Filed: Apr. 20, 1984

[30] Foreign Application Priority Data

Apr. 28, 1983 [DE] Fed. Rep. of Germany ..... 3315417

[51] Int. Cl.[4] ..... B21F 3/04; B21F 45/00

[52] U.S. Cl. ..... 72/128; 72/137; 140/71 R; 264/281

[58] Field of Search ..... 72/128, 137, 138, 142, 72/143; 140/1, 71 R, 71.5, 92.1, 92.2, 103, 105; 264/DIG. 40, 281

[56] References Cited

U.S. PATENT DOCUMENTS

| | | | |
|---|---|---|---|
| 2,513,164 | 6/1950 | Genua | 72/137 |
| 2,868,236 | 1/1959 | Smith | 140/105 X |
| 3,197,537 | 7/1965 | Hansen | 264/DIG. 40 |
| 3,207,827 | 9/1965 | Kuehnle | 264/281 X |
| 3,337,672 | 8/1967 | Steingrubner | 264/281 |
| 3,341,917 | 9/1967 | Oyabu et al. | 29/527.4 |
| 3,431,337 | 3/1969 | Heimberger | 264/281 |
| 3,566,927 | 3/1971 | Adams | 140/71 R |
| 3,608,147 | 9/1971 | Galonska | 264/281 X |
| 3,666,853 | 5/1972 | Popovitsch | 264/281 |

FOREIGN PATENT DOCUMENTS

| | | | |
|---|---|---|---|
| 222751 | 1/1962 | Austria | 140/71.5 |
| 564457 | 10/1957 | Canada | 140/71.5 |
| 2419751 | 8/1978 | Fed. Rep. of Germany . | |
| 2938221 | 10/1980 | Fed. Rep. of Germany . | |

*Primary Examiner*—E. Michael Combs

*Attorney, Agent, or Firm*—Michael J. Striker

[57] ABSTRACT

In a method and an arrangement for winding and forming helixes of elastic synthetic plastic and metal wire the wire is supplied from a wire supply device, windings are then wound from the wire so as to form straight winding legs connected by head curves, the windings are then separated to provide distances therebetween, the separated windings are widened in correspondence with the distances between them produced during the separation and the finished helixes are supplied to a helix supply device.

54 Claims, 12 Drawing Figures

METHOD AND ARRANGEMENT FOR WINDING AND FORMING HELIXES OF ELASTIC PLASTIC OR METAL WIRE

BACKGROUND OF THE INVENTION

The present invention relates to a method of and an arrangement for winding helixes of elastic synthetic plastic and metal wire. More particularly, the invention relates to a method of and arrangement for winding and forming helixes with windings including substantially straight winding legs and head curves connecting the winding legs to one another, for example for flat shaped articles, such as sieve bands or composite bands for paper machines and the like.

Flat shaped articles of the above-mentioned general type are disclosed, for example, in the DE-PS No. 2,419,751 and DE-OS No. 2,938,222. In accordance with the DF-PS 2,419,751 the wire helixes have a pulling spring-like tensioning which produces contractions of the neighboring wire helixes of the flat shaped article against one another. In the DE-OS No. 2,938,222 the helixes do not have pulling-spring like tensioning. Their wire is torsion-free, so that the service life of the thus formed flat shaped article is increased. Both types of the flat shaped articles possess, however, some disadvantages.

Flat shaped articles which have helixes with mainly round or slightly oval wires with constant cross-section naturally have a high air permeability. It is required here that the intermediate space between the carrying winding legs correspond to the wire diameter. For reducing the high air permeability, for example during the paper manufacture, filling elements are introduced into the helixes. Though they influence in the air permeability, they require a considerable labor expenditure. The filling elements are composed mainly of cotton or synthetic plastic parts which can be introduced into the helixes with relatively great difficulties. In addition to the increased labor consumption, the price of the thus produced material increases as well. Helixes of round wire possess also the property that the paper during its manufacture is in a point contact with the flat shaped article. This leads to printing of the winding legs on the finished paper. The point-like or edge-like contact between the carrying winding legs of the helixes of the flat shaped articles and the paper leads to the fact that the heat flow between the calendar roller and the paper is weak because of the only small abutment possibilities and therefore small contact surfaces. In order to eliminate this disadvantage the helixes are produced of flat wires. The carrying winding legs of the flat wires provide for greater contact surfaces with the paper. However, as before an increased air permeability of the flat shaped article must be taken into consideration, since the distance between the individual windings of the helixes are great. This can lead to the phenomenon that the paper during its manufacture has an inclination to flatter. Moreover, there are difficulties during manufacture of the flat shaped articles when the helixes of flat wire are used.

In order to combine the advantage of easy manufacture of a flat shaped article with round wire helixes with the advantage of wider supporting surface and better heat transfer with a limited air permeability, it has been proposed to form the carrying winding legs so that they have flat supporting surfaces with a width which is greater than the wire diameter or the wire width of the head curves. It has been shown that these helixes are assembled as easy as the helixes of a round wire, or since the used helixes are more accurate and smooth than the known helixes. The intermediate spaces between the individual winding legs can be greater or smaller as needed. Here not only advantageously wider flat receiving surfaces of the carrying winding legs are obtained, but also an air stream of desired power is provided without insertion of filling elements between the winding legs or inside the helixes. These flat-shaped articles are disclosed in U.S. patent application Ser. No. 513,986.

SUMMARY OF THE INVENTION

Accordingly, it is an object of the present invention to provide a method of and arrangement for producing the abovedescribed helixes in a simple manner.

In keeping with these objects and with others which will become apparent hereinafter, one feature of the present invention resides, briefly stated, in a method of winding and forming helixes in accordance with which a wire is supplied from supply means, windings are then wound in winding means so as to form windings with substantially parallel straight winding legs and head curves connected them with one another, then the windings can be subjected to thermal treatment, after this the windings can be separated so as to provide distances therebetween, and the windings at one side are flattened and widened, in correspondence with the distances between the windings if they have been previously separated, and finally the thus formed helixes are supplied to helix supplying means.

The helixes can be used both for manual and for the automatic assembling by machines.

In accordance with the inventive method it is possible to flatten and widen all straight winding legs lying at both sides of the windings. The manufacturing methods used for this process depend upon the field of use of the helixes. When high tightness against ventillation is required, in the manufacture of the flat shaped articles such helixes are used in which both winding legs are flattened or widened. In all other cases it is sufficient when the helixes have flattened or widened straight winding legs at only one side of the windings.

Without changing the core of the invention, in some special application cases it is not necessary to flatten or widen all straight winding legs. It is also within the spirit of the invention, when the flattening and widening of the straight winding legs corresponds to the requirements of the practical use.

For preventing the phenomenon that the head curves of the neighboring helixes lie because of the elastic pulling force inside the helixes against one another, the winding distances produced by separation of the windings are fixed. This fixation is performed in a known manner so that the distance between the mutually facing surfaces of the head curves is greater than the width of a head curve. Because of this the head curves lie loosely and spatially without pulling springlike tensioning near one another.

A somewhat different method of winding and forming the helixes in accordance with the present invention is performed in that the wire is supplied from wire supply means so as to form windings pulled back by a winding cone and provided with tightly located head curves and parallel straight winding legs, wherein all straight winding legs located at one side of the windings (in some cases after a thermal treatment and a separation) are flattened, for example in a material removing manner, and the thus formed helixes are supplied to helix supplying means. The helixes produced in accordance with this method have at its one side only flattened straight winding legs. These windings legs are not widened, so that the distance between them corresponds to the wire thickness. The flat shaped article produced from these helixes eliminates a point-or edge-like contact, for example with paper, and provides sufficient intermediate space for the ventillation.

In accordance with a further embodiment of the invention the straight winding legs located at both sides of the windings can be flattened. Here it is also true that not all winding legs must be flattened, as in the previous embodiment, so that between the flattened winding legs also individual or several winding legs can be provided in their initial form.

In the last-mentioned embodiment of the inventive method the windings of the helixes can also be fixed in the selected winding distance, as mentioned hereinabove.

In both embodiments of the inventive method, depending upon the use of the helixes it is possible or necessary to bring the straight winding legs of each winding to different widths and/or to provide the flattening of the same with different widths.

Without changing the core of the present invention, the straight winding legs of each winding can have the same width and/or provided with the same flattening. In special cases it is advantageous when one or both straight winding legs of each winding are brought to a width which is at least double the width of the initial wire diameter of the head curves. In these cases the winding distances are selected so that the windings of the helixes can be fixed with winding distances which allow a tension free arrangement of the head curves of the neighboring helixes near one another.

In accordance with another especially advantageous feature of the present invention, the thermal treatment of the helixes, the separation of their windings, the flattening and/or widening of the straight winding legs, and the supplying of the helixes to helix supplying means can be performed in a special arrangement connected with an available winding device.

Without changing the core of the invention, it is also possible to perform winding of the helixes, the thermal treatment, the separation of their windings, and the flattening and/or widening of their straight winding legs as well as the supplying of the helixes in an arrangement which is formed as a single machine or unit.

The present invention also deals with an arrangement for winding and forming the helixes from elastic synthetic plastic or metal wire and having windings with substantially straight winding legs and head curves connecting the same with one another, for jointing of flat shaped articles, for example to be used as sieve bands or composite bands in paper machines, when this arrangement is used for performance of the above-described method. Such an arrangement has wire supply means, winding means which can be composed of a fixed winding cone and a fixed mandrel with parallel longitudinal sides and small sides which can be curved, thermally treating means surrounding the mandrel, means for separating and transporting the windings, and means for flattening and widening of the straight winding leg located at one longitudinal side of the fixed mandrel.

For allowing an easy displacement of the winding along the mandrel, a discharge wedge is provided behind a fixed winding cone of the winding means at one smaller side of the mandrel. Thereby during winding of the respective last winding the windings obtain a drive in direction to the end of the mandrel so that the movement because of this drive, because of the decrease of the mandrel resulted from the winding wedge is facilitated.

The thermally treating means for treating the helix movable on the mandrel can include a heating tunnel with a radiation heating body, a nozzle for supplying hot air, a pipe conduit for supplying a hot liquid in the tunnel.

The means for separating the tightly wound windings of the helix is provided behind the heating tunnel and can include a plurality of cutters arranged at a desired winding distance and operative so that, starting from the separating region, they move in the movement direction of the helix near the fixed mandrel and simultaneously transport the helix along the mandrel. It is very important that the cutters in the separating region engage between the head curves of the winding. The separation and transportation of the windings takes place thus at the small sides of the helixes.

In accordance with the present invention the separation of the windings can be performed by the cutters provided in the separating and transporting screws, in link members of separating and transporting chains, at both opposite small sides of the fixed mandrel and with heating of a carrier which carries the cutters. The method selected for separation depends upon the fact which inclined position of the individual straight winding leg relative to the longitudinal axis of the mandrel or the helix must be provided. In many cases it is desired that the carrying winding leg extend parallel to the movement direction of the flat shaped article. In this case the respective other winding leg of the winding extends inclined relative to the central axis of the helix. In other cases, the carrying winding legs have the reversed equal inclination to the central axis as the carrying winding legs of the oppositely located winding legs of the windings. By a simple displacement of the cutters relative to one another, it is possible to change the value of the angular position of the winding legs relative to the center line of the helixes when needed.

The means for widening the straight winding legs include at least a hammer or knocker which is arranged opposite to one longitudinal side of the mandrel in the screw wheels or cutters of the separating and transporting means. The widening means can also include an anvil located at the opposite side or a counter hammer or counter knocker located at the opposite side. The hammer or knocker can be provided with a mechanical drive such as a cam drive, with a pneumatic or hydraulic drive such as a piston drive, with an electromagnetic drive, with a piezoelectric drive, with a high frequency drive, with an ultrasonic drive. The widening means can also include a pressing roller or a pressing band. A heating device can be connected with the widening means for heating the windings, and the widening means can be provided with a heating coulisse. Normally the plastification of the material prior or during the widening is possible by heating. In many cases it is possible to obtain the required heat quantity by the deformation work of the hammer in the straight winding leg so as to attain a sufficient plasticity. When this is not possible, the mandrel is heated, for example by induction method, in the arrangement for widening the winding leg or supplied with heat in another manner. The thermal energy supplied in the heating station is often sufficient to guarantee a certain pre-heating.

In the case when the straight winding leg must not be widened but only flattened, the flattening is performed by a material removing device, for example a grinding device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a perspective view of a section of the inventive arrangement, taken along the line III—III in FIG. 1 and showing a separating and transporting device and a widening device;

FIG. 4 is a view showing a section of the inventive arrangement taken along the line IV—IV in FIG. 1 and showing the widening device in accordance with another embodiment of the invention;

DESCRIPTION OF PREFERRED EMBODIMENTS

Figure 1:
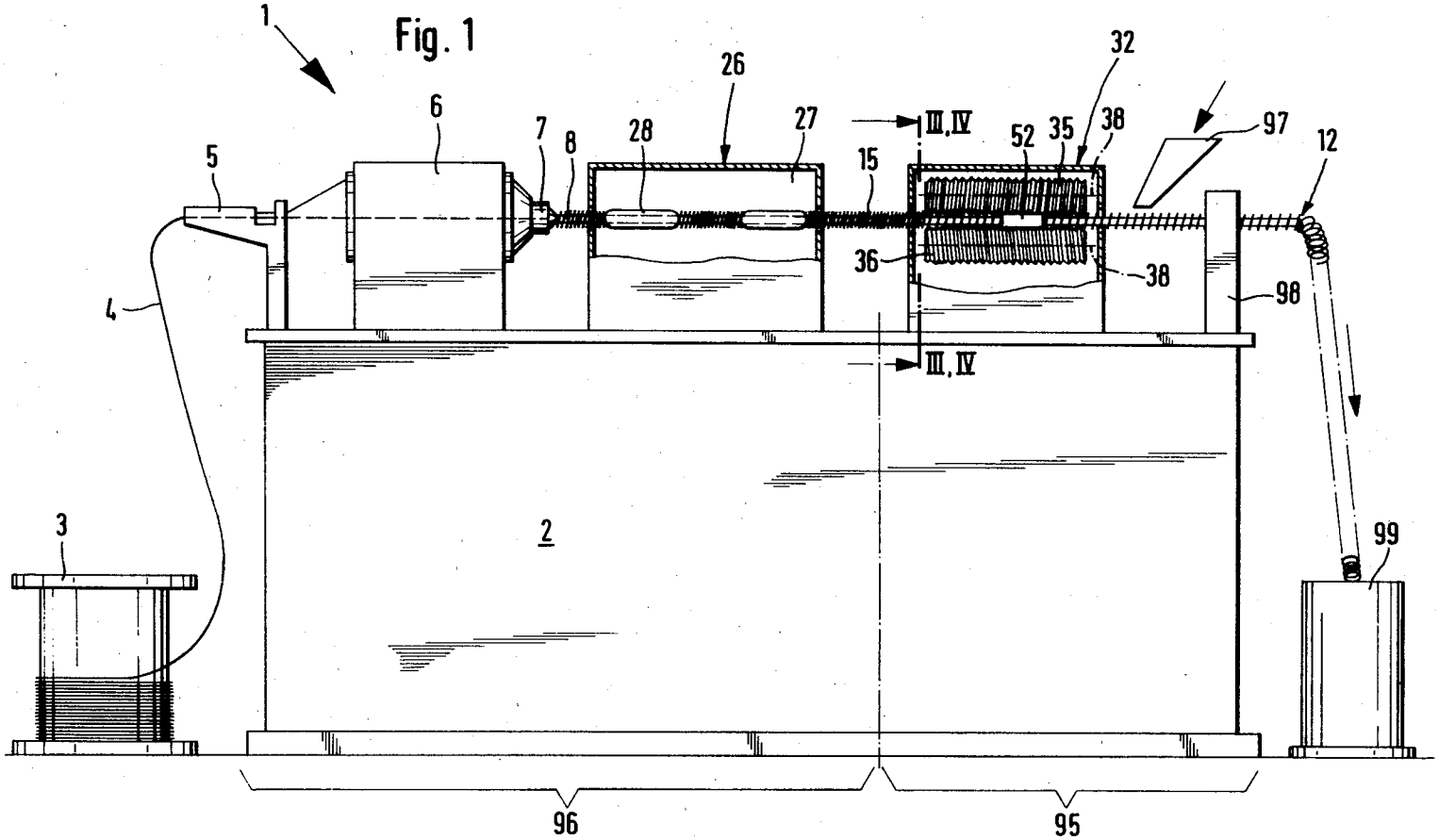
FIG. 1 is a general view of an arrangement for winding and forming helixes in accordance with the present invention.
Figure 2:
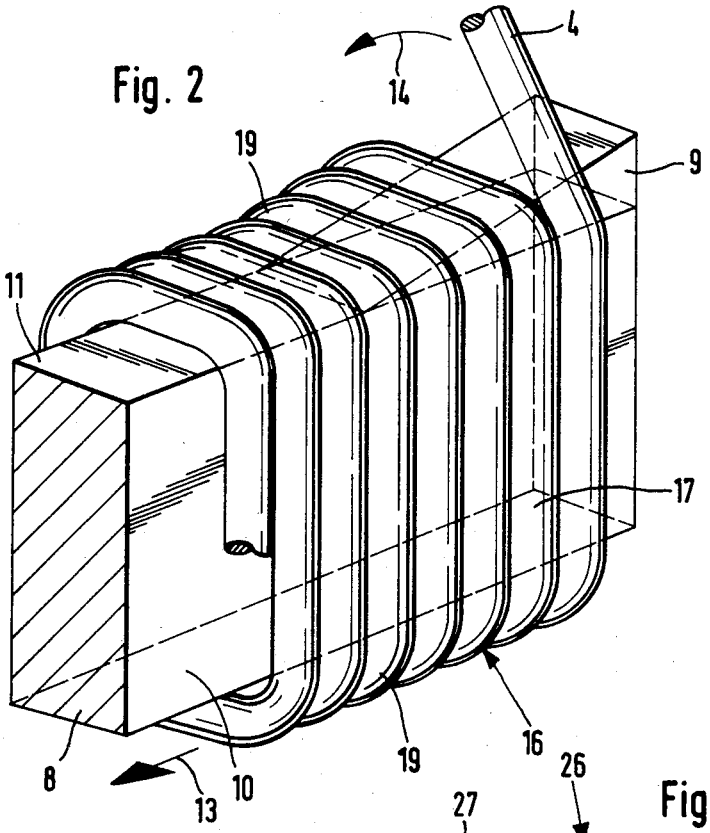
FIG. 2 is a view showing a discharge wedge arranged after a fixed winding cone.

FIG. 1 schematically shows an arrangement 1 for winding and forming of helixes. The individual parts of the arrangement are arranged on a working table 2. A wire 4 of a synthetic plastic or metal is supplied from a wire supplying device 3 which can be formed, for example, as a feed roller, through a wire guide 5 to a winding device 6. The winding device 6 operates with a fixed winding cone 7 connected with a fixed mandrel 8. The mandrel 8 is shown in FIG. 2 on an enlarged scale. It has two opposite longitudinal surfaces 10 and two small surfaces 11. The cross-section of the fixed mandrel 8 is substantially rectangular. However, the small surfaces 11 can also be formed arcuate.

The winding device 6 is formed as a known winding device by which the wire 4 is guided around the fixed winding cone 7. This is identified in FIG. 2 by the arrow 14.

As can be seen from FIG. 2, the discharge wedge 9 is provided, which is shown in broken lines in the upper region of FIG. 2. It abuts against one smaller surface 11 of the fixed mandrel 8. Its inclined plane provides, despite the strong winding of the wire 4 in the winding device 14, a displacement of windings 16 of a helix 15 along a displacement direction 13 identified by the arrow in FIG. 2. FIG. 2 shows that each winding 16 is composed of two opposite straight winding legs 17 and 18 (see also FIG. 3) and two connecting head curves 19.

A device 26 for thermal treatment of the helix 15 is connected with the winding device 6. In the schematic showing of FIG. 1, this device 26 for thermal treatment includes a heating tunnel 26 and a radiation heating body 28 provided in the tunnel.

When the helix 15 leaves the device 26 it is released from inner stresses by the heat treatment performed in the device. It can then be supplied for a further treatment in a device 32 for separation and transportation of the windings. This device 32 is schematically shown in FIG. 1. It includes two separating and transporting screws 35 and 36 which engage the head curves 19 in a manner which will be explained hereinbelow.

A device 52 for widening the straight winding legs is arranged in a plane normal to the longitudinal surfaces 10 of the fixed mandrel 8 as can be seen from FIG. 1. The details of this device will be explained hereinbelow.

The separating and transporting screws 35 and 36 are rotatable about their axes of rotation 38 which extend parallel to the fixed mandrel 8.

Normally the helix 15 travels in connection with the device 32 for separation and transportation of the windings and the device 52 for widening the straight winding legs in a brake 98 which is arranged before the free end 12 of the fixed mandrel 8. The brake 28 serves to guarantee that the helix 15 leaves orderly the next mandrel 8 and travels to a helix supply device 99. In practical embodiment the helix supply device 99 is formed as a storage inside a container, for example a barrel. Without changing the core of the invention, at the free end 12 of the fixed mandrel 8 a separating device can be provided by which the helix supply device 99 can be portionered.

The arrangement 1 for winding and forming the helixes can be delivered in assembled condition, as shown in FIG. 1 and explained hereinabove. However, it can also be delivered as a separate device 95 which is connected with an available winding device 96.

In the event if a repeated tensionless making of the helix 15 in connection with the devices 32 for the separation and transportation of the windings 52 for widening of the straight winding legs is necessary, a blowing pipe 97 is provided which can blow warm or cold air onto the helix 15 when desired.

FIG. 3 shows an embodiment of the arrangement in accordance with the present invention in a perspective view along the line III, IV in FIG. 1.

The helix is moved in direction of the arrow 13 in FIG. 2 onto the mandrel 8 which is shown here, in contrast to FIG. 1 in a lying position. The transportation and separation of the windings is performed by separating and transporting screws 35 and 36 which rotate in opposite directions about the axes 38. The axes 38 rotate parallel to the mandrel 8.

A schematically shown anvil 63 is arranged underneath the lower straight winding leg 18. A hammer or knocker 56 is provided above the upper straight winding leg 17 and has a lower surface which acts upon outer surface 20 of several upper straight winding legs 17 located one behind the other. The double arrow identifies the movement direction of the hamer 56.

As can be seen from FIG. 3, the device 32 for separation and transportation of windings extends in a horizontal plane shown in FIG. 3, whereas the device 51 for widening of the straight winding legs extends, to the contrary, in a plane normal thereto. The separating and transporting screws 35 and 36 have convolutions 37 with outer regions formed as cutters 33.

Figure 6:
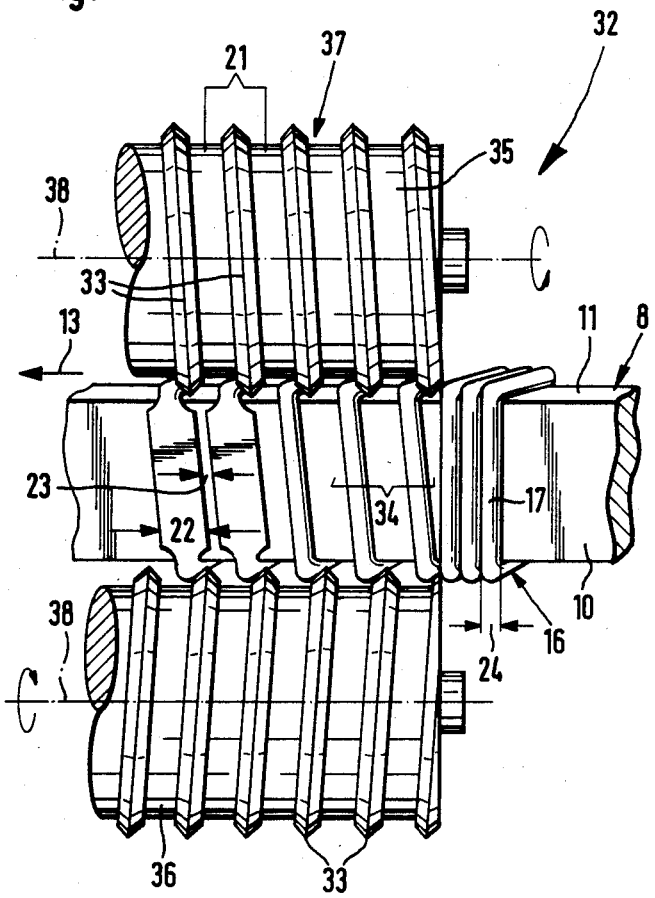
FIG. 6 is a view showing a separating and transporting device of the inventive arrangement in accordance with another embodiment of the invention.

As shown in detail in FIG. 6, the cutters 33 engage between neighboring head curves located opposite to one another, whereby the thus engaged winding of the windings of the helix 5 coming from the device 26 for the thermal treatment is separated. The head curves then travel through the individual convolutions of the screws which not only transport the windings but also holds them in the desired distance relative to one another during the running through the device 52 for widening the straight winding legs. A length 39 of the screws 35 and 36 corresponds to the length of the hammer or knocker 56.

The hammer or knocker 56 is mechanically driven in correspondence with FIG. 3. For this purpose, sliding pieces 57 are provided on the hammer and arranged to move upwardly and downwardly on sliding rods 58 against the force of spring 59 in direction of the double arrow. The sliding rods 58 are seated in the respective elements of a frame which is not shown in the drawing.

The hammer or knocker 56 is provided with an abutment piece 60 cooperating with a cam 61. The cam 61 is arranged on a cam shaft 62 and rotates in the direction of the curved arrow. In the shown embodiment the springs 59 are formed as pulling springs. Without changing the core of the invention, the mechanical drive can also operate with pressing springs, in which case the abutment piece 60 and cam 61 are formed respectively.

With the above described mechanical cam drive device, the hammer or knocker 56 can operate with a desired high number of oscillations so that widening of the winding legs is performed.

FIG. 4 shows another embodiment of the present invention with a device 54 for widening the straight winding legs. The hammer or knocker 55 is again provided above the outer surface 20 of the upper straight winding leg 17 and is movable in direction of the double arrow. The hammer or knocker 56 is connected via a connecting rod 72 with a piston 71 which is movable in a cylinder 70 connected by supply and discharge conduits 73 with a source of pneumatic or hydraulic medium. The piston 71 can perform in the cylinder 70 by the above mentioned pneumatic or hydraulic drive past oscillations, as known in the art, which as a result provide for widening of the upper winding leg 17.

A counter hammer or counter knocker 64 is located opposite to the outer surface 20 of the lower straight winding leg 18 in FIG. 4 and is also movable in direction of the double arrow. A drive with an electromagnet system 9 is provided for movement of the counter hammer or counter knocker 64. More particularly, sliding rods 67 are provided on a traverse 65, springs 68 are wound around the sliding rod 67, and a projection of the counter hammer or counter knocker 65 can slide on the sliing rod 67 by its sliding openings 66. In the shown embodiment, the springs 68 are formed as pressing springs whose force is overcome by the electromagnet 69. When the magnet 69 is demagnetized, the counter hammer or counter knocker 64 is accelerated because of the force of the springs 65 so that the counter hammer or counter knocker 64 strikes against the outer surface 20 of the lower winding leg 18. Without changing the core of the invention, the force conditions between the electromagnet 69 and the springs 68 can be reversed so that the springs are formed as restoring springs, whereas the electromagnet 69 drives the counter hammer or counter knocker 64 against the outer surface 90 of the lower straight winding leg 18 against the force of the springs.

Figure 5:
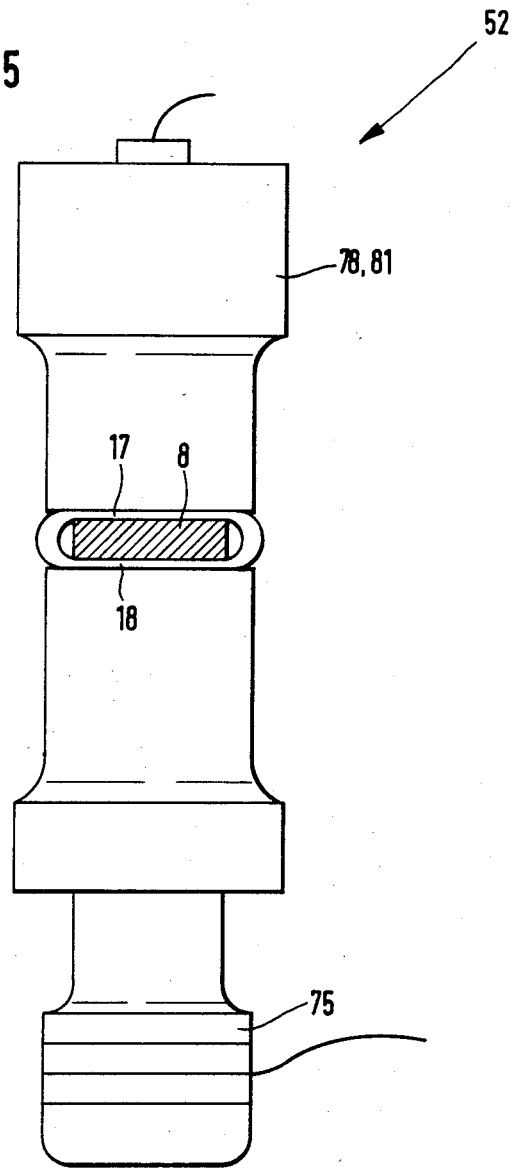
FIG. 5 is a view showing a widening device of the inventive arrangement in accordance with a further embodiment of the invention.

The hammer or knocker 56 and the counter hammer or counter knocker 64 can be driven in a known manner with the desired impact frequency. FIG. 5 schematically shows two further drives. The device 52 for widening the straight winding legs is formed in the upper region of FIG. 5 either as a high frequency drive 78 or as an ultrasone drive 81. Such striking mechanisms driven by high frequency or ultrasound are known so that they are not described here in detail.

The upper straight winding leg 17 and the lower straight winding leg 80 are only schematically shown above and below of the fixed mandrel shown in section. A piezoelectric drive 25 is provided underneath the lower straight winding leg 18 and drives the counter hammer or the counter knocker 64. Without changing the core of the invention, the drive for the hammer or knocker can be replaced by other respective devices.

FIG. 6 schematically shows the separation of the windings and the widening of the winding legs. The windings 16 with the longitudinal surfaces 10 and small surfaces 11 are moved on the fixed flat mandrel 8 in the above described manner in the movement direction 13. The windings are composed of synthetic plastic or metal wire with a diameter 24. The straight winding leg 17 can be seen in the rightmost winding 16 in FIG. 6. Both separating and transporting screws 35 and 36 with convolutions 37 are arranged rotatable about the axes 38 parallel to the fixed mandrel 8. Both screws 35 and 36 rotate oppositely to one another in direction of the curved arrows about the axes of rotation 38.

The cutters 38 of both screws engage in the region between the windings 16 which lie narrowly near one another. Because of this the windings are separated from one another. The distance between the windings which is thus produced depends from the dimension of the convolutions 37. In the shown embodiment a winding distance 21 is produced by the profile of the convolutions 37. As can be seen from FIG. 6, this distance is selected so that during widening of the straight winding legs to a width 22, a distance 23 remains between neighboring widened winding legs. If in the device 52 for widening the straight winding legs another adjustment is provided, the width 22 can be greater or smaller. Correspondingly the distance 23 is reduced or increased.

In accordance with FIG. 6, the separating and transporting screws 35 and 36 are arranged in a certain position relative to one another, which provides an inclined position of the straight winding leg relative to the center line. By a lateral displacement of one or the other separating and transporting screws 35, 36 this inclined position can be varied.

Figure 7:
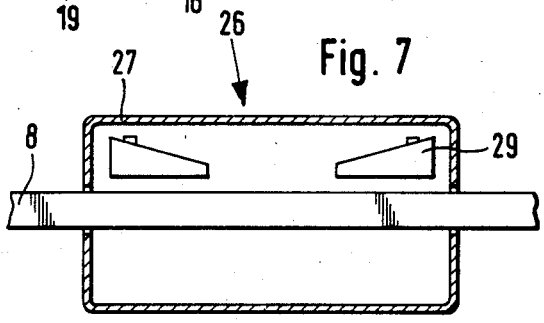
FIG. 7 is a view showing a thermal treatment device of the inventive arrangement.
Figure 8:
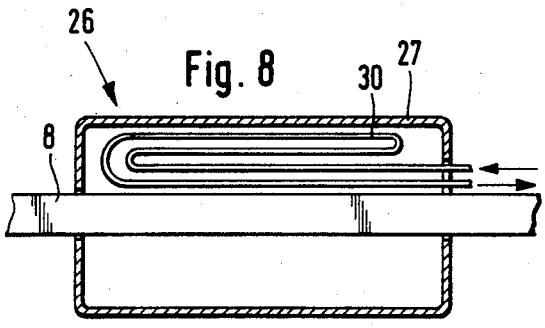
FIG. 8 is a view showing a thermal treatment device of the inventive arrangement, in accordance with another embodiment of the invention.

FIG. 7 shows one embodiment of the device 26 for thermal treatment with a heating tunnel 27, and nozzles 29 for supplying hot air arranged in the tunnel. FIG. 8 shows another embodiment of the device 26 for thermal treatment, which has a heating tunnel 27 and pipes 30 arranged in the latter. A heating medium, for example, hot air or hot liquid is pumped through the pipes 30.

Figure 9:
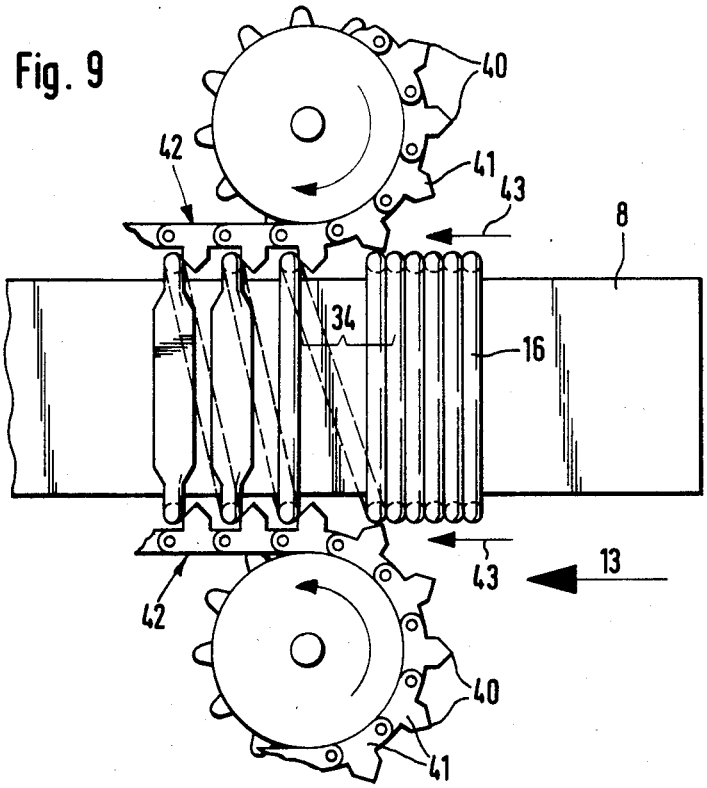
FIG. 9 is a view showing a separating and transporting device of the inventive arrangement in accordance with yet another embodiment of the invention.

FIG. 9 shows a further embodiment of the invention. Here again, windings 16 arranged on the fixed mandrel 8 travel in the movement direction 13 on the fixed mandrel 8. Cutters 40 act in the separating region 34 and arranged on chain links 41 of separating and transporting chains 42. The chain links 41 are pivotably connected with one another. Their loading run 43 moves so that the windings 16 are transported in the movement direction 13.

The lower winding leg is shown in broken lines under the partially or completely widened winding leg. The inclined position of this winding leg is nonequally greater than the inclined position of the upper widened winding leg. Because of the relative displacement of both separating and transporting chains 42, the value of the inclination of the straight winding legs to the center line of the helix is varied.

Figure 10:
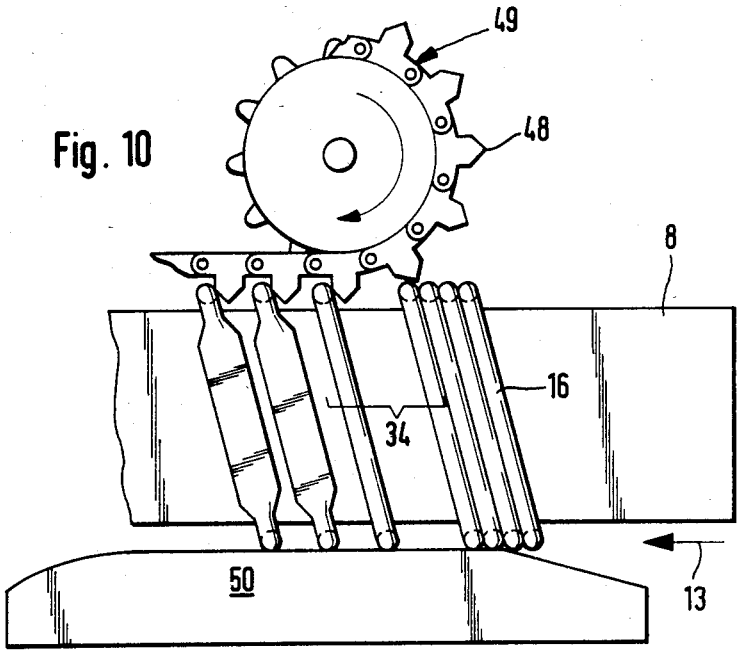
FIG. 10 shows another separating and transporting device of the invention.

FIG. 10 shows a further embodiment with the fixed mandrel 8, the windings 16 which are transported in the movement direction 13, and a separating region 34. A counter holder 50 is shown in the lower part of FIG. 10 and arranged opposite to a separating and transporting chain 49. The transporting chain moves in the direction of the arrow. Their cutters 48 engage as shown, between two head curves, so that the windings 16 are separated and transported in the movement direction 13. In the embodiments of FIGS. 9 and 10 the devices 52 for widening of the straight winding legs are not shown.

Figure 11:
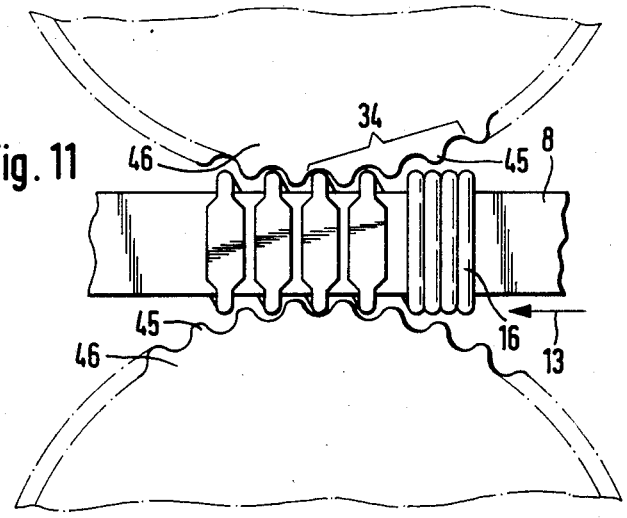
FIG. 11 shows a further separating and transporting device of the invention.

FIG. 11 finally shows a cutter wheel 46 with cutters 45 which perform in the separating regions 34 the separation of the windings 16 and their transportation in the movement direction 13. The arrangement 52 for widening of the straight winding legs is not shown in FIG. 11.

Figure 12:
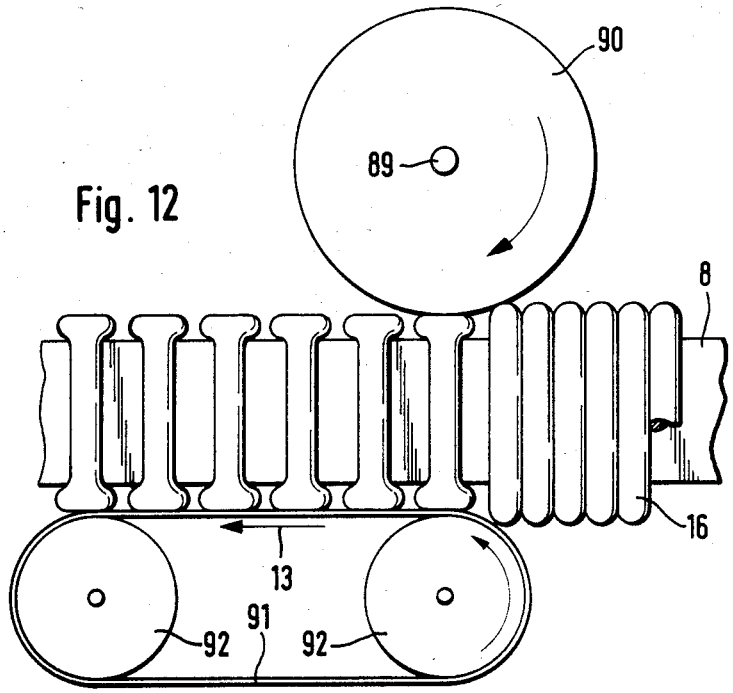
FIG. 12 is a view showing a flattening device of the inventive arrangement.
Figure 13:
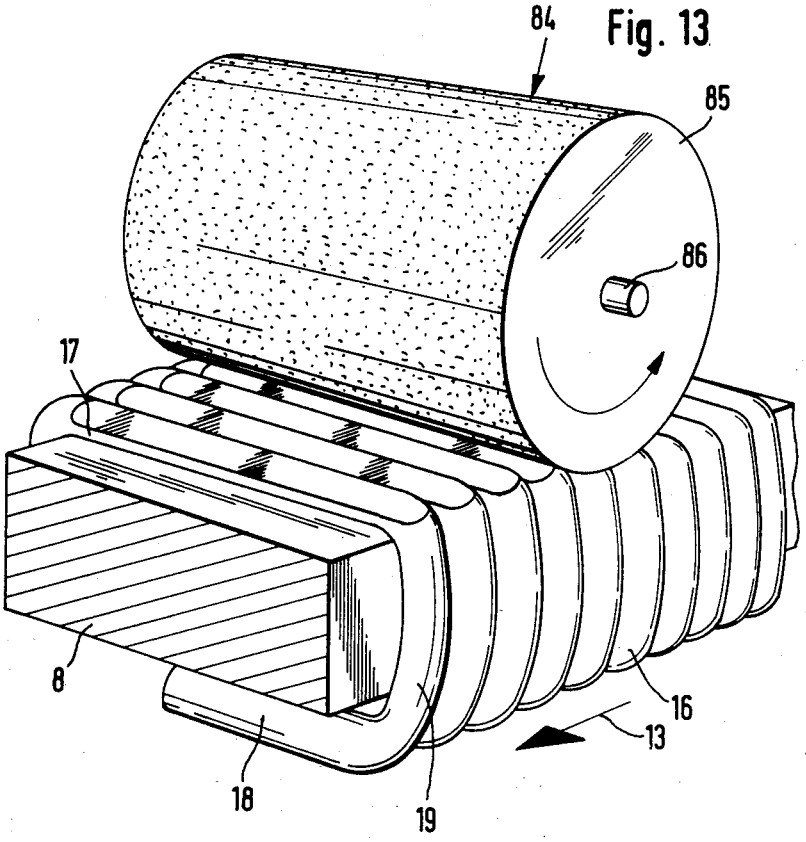
FIG. 13 shows another embodiment of the inventive flattening device.
Figure 14:
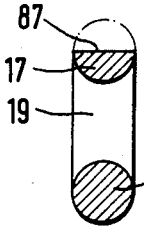
FIG. 14 is a view showing a winding with one flattened winding leg.

FIG. 12 also shows the windings 16 on the fixed mandrel 8 movable in the movement direction 13 by one of the above described devices which is not shown in FIG. 12. For widening of the winding legs a pressing roller 90 is shown in the upper region of FIG. 12 and is driven about an axis of rotation 89 in the direction of the curved arrow. A pressing band 91 is located underneath the mandrel 8 and guided about two deviating wheels 92. The curved arrow shows the direction of rotation of the right deviating wheel 92.

The above described arrangements provide for any desired separation of the windings 16 and any desired widening of their straight winding legs. Each shown arrangement can be adjusted so that the winding leg located on at one side of the helix can be flattened or widened, or also both straight winding legs of a helix.

It will be understood that each of the elements described above, or two or more together, may also find a useful application in other types of constructions differing from the types described above.

While the invention has been illustrated and described as embodied in a method of and arrangement for winding of helixes it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of winding and forming of helixes of elastic synthetic plastic or metal wire with windings having substantially straight winding legs and head curves connecting the latter, the method comprising the steps of supplying a wire from supply means; winding the wire so as to form a plurality of windings with head curves lying tight against one another and with parallel straight winding legs; separating the windings without their deformation and providing selected distances therebetween; transporting the windings by exerting a force on the windings only in the region of the head curves; and flattening and widening only the separated straight winding legs located at least at one side of the windings without flattening and widening of the head curves, by deforming only the separated straight winding legs located at least at one side of the windings.

2. A method as defined in claim 1; and further comprising the step of separating the wound windings with formation of distances therebetween.

3. A method as defined in claim 1; and further comprising the steps of thermally treating the windings after said winding step.

4. A method as defined in claim 2, wherein the flattening step includes widening of all straight winding legs located at one side of the winding in correspondence with the distances obtained during the separating step.

5. A method as defined in claim 1, wherein said widening step includes widening of the straight winding legs located at both sides of the windings.

6. A method as defined in claim 2, wherein said separating step includes fixing the distances between the windings.

7. A method as defined in claim 4, wherein said widening step includes forming a widening on the straight winding legs located at one side of the windings.

8. A method as defined in claim 7, wherein said widening forming step includes forming the widening on the straight winding legs located at both sides of the windings.

9. A method as defined in claim 7, wherein said widening step includes fixing the distances between the windings.

10. A method as defined in claim 5, wherein said widening and winding steps includes bringing both straight windings legs to different widths.

11. A method as defined in claim 8, wherein said said widening forming step includes providing both straight winding legs of each winding with the widening of different widths.

12. A method as defined in claim 5, wherein said widening step includes bringing both winding legs of each winding to identical widths.

13. A method as defined in claim 8, wherein said widening forming step includes forming the widening on both straight winding legs of each winding with identical widths.

14. A method as defined in claim 4, wherein said wire supplying and widening steps includes forming the head curves with the wire of a predetermined wire diameter, said widening step including bringing the straight winding leg of each winding to a width which is at least twice as wide as the wire diameter of the head curves.

15. A method as defined in claim 4; further comprising the step of thermally treating the windings after the winding step; separating the windings after the thermally treating step so as to form distances therebetween; and performing said winding step, thermally treating step, separating and widening step, and helix supplying step in an arrangement formed as a single unit.

16. A method as defined in claim 4; further comprising the steps of thermally treating the windings after said winding step, separating the windings so as to form distances therebetween; performing said steps of thermally treating, separating, widening, and helix supplying in an arrangement formed as one unit; and performing said winding step in a separate winding arrangement.

17. A method as defined in claim 1, wherein said separating and transporting steps are effected by separating and transporting means and flattening and widening of the straight legs of the windings is effected by flattening and widening means positioned at the same location as said separating and transporting means as considered in a transporting direction and between said separating and transporting means as considered in a direction which is transverse to the transporting direction.

18. A method as defined in claim 1, wherein said flattening and widening step is performed independently of said winding step.

19. An arrangement for winding and forming helixes of elastic synthetic plastic or metal wire with windings having substantially straight winding legs and head curves connecting the latter, comprising wire supply means; wire winding means arranged to wind a wire so as to form windings with substantially straight winding legs and head curves connecting the latter; means for separating the windings without their deformation to provide selected distances therebetween; means for transporting the windings by exerting a force on the windings only in the region of the head curves; and means for flattening and widening only the separated straight winding legs on at least one side of the windings without flattening and widening of the head curves by deforming only the separated straight winding legs located at least at one side of the windings.

20. An arrangement as defined in claim 19, wherein said winding means includes a fixed winding cone; and a fixed mandrel having longitudinal sides and small sides, said longitudinal sides extending parallel to one another.

21. An arrangement as defined in claim 20, wherein said small sides of said fixed mandrel are curved.

22. An arrangement as defined in claim 20; and further comprising thermally treating means for treating the windings movable on said mandrel, said treating means surrounding said mandrel.

23. An arrangement as defined in claim 19; and further comprising means for separating and transporting the windings after their winding, arranged before said widening means.

24. An arrangement as defined in claim 20, wherein said winding means includes a discharge wedge arranged on one small side of said mandrel behind said winding cone.

25. An arrangement as defined in claim 19, wherein said thermally treating means includes a heating tunnel.

26. An arrangement as defined in claim 25, wherein said thermally treating means further includes a radiation heating body arranged in said heating tunnel.

27. An arrangement as defined in claim 25, wherein said thermally treating means includes a nozzle for blowing hot air and located in said heating tunnel.

28. An arrangement as defined in claim 25, wherein said thermally treating means includes at least one pipe for supplying a hot liquid and arranged in said heating tunnel.

29. An arrangement as defined in claim 23, wherein said separating and transporting means is arranged to separate the windings in a separating region and transport the windings in a transporting direction, said widening means including means for widening the straight winding legs and having a fixed mandrel with longitudinal and small sides, said separating and transporting means including a plurality of cutters spaced from one another by desired winding distance and arranged, starting from said separating region to move in said transporting direction near said fixed mandrel and simultaneously transport the windings along said mandrel.

30. An arrangement as defined in claim 29, wherein said cutters of said separating and transporting means are arranged so that they engage in said separating region between the head curves of the windings.

31. An arrangement as defined in claim 29, wherein said cutters of said separating and transporting means are formed as convolutions of at least one one-thread separating and transporting screw having an axis of rotation parallel to said mandrel.

32. An arrangement as defined in claim 31, wherein said separating and transporting screw is formed as a relatively long screw.

33. An arrangement as defined in claim 29, wherein said cutters of said separating and transporting means are formed as chain links of at least one separating and transporting chain with a working run displaceable near said fixed mandrel.

34. An arrangement as defined in claim 29, wherein said cutters of said separating and transporting means are arranged near said two opposite small sides of said fixed mandrel.

35. An arrangement as defined in claim 29, wherein said separating and transporting means includes a carrier arranged to support said cutters and being heatable.

36. An arrangement as defined in claim 29, wherein said means for widening the straight winding legs includes a hammer member arranged opposite to one longitudinal side of said mandrel between said cutters of said separating and transporting means.

37. An arrangement as defined in claim 36, wherein said widening means further includes an anvil arranged at the opposite longitudinal side of said mandrel.

38. An arrangement as defined in claim 36, wherein said widening means further includes a counter hammer arranged at the opposite longitudinal side of said mandrel.

39. An arrangement as defined in claim 36, wherein said hammer of said widening means is mechanically driven; and further comprising mechanical driving means for driving said hammer.

40. An arrangement as defined in claim 39, wherein said mechanical driving means for driving said hammer includes a cam drive.

41. An arrangement as defined in claim 36, wherein said hammer of said widening means is driven in a fluid-operated manner; and further comprising a fluid-operated drive for driving said hammer.

42. An arrangement as defined in claim 41, wherein said fluid-operated drive means for driving said hammer includes a piston drive.

43. An arrangement as defined in claim 36, wherein said hammer of said widening means is driven in an electromagnetic manner; and further comprising electromagnetic drive means for driving said hammer.

44. An arrangement as defined in claim 36, wherein said hammer of said widening means is driven in piezoelectric manner; and further comprising a piezoelectric drive means for driving said hammer.

45. An arrangement as defined in claim 36, wherein said hammer of said widening means is driven in a high frequency manner; and further comprising high frequency drive means for driving said hammer.

46. An arrangement as defined in claim 36, wherein said hammer is driven in an ultrasonic manner; and further comprising ultrasonic drive means for driving said hammer.

47. An arrangement as defined in claim 29, wherein said widening means for widening the straight winding legs includes a pressing roller.

48. An arrangement as defined in claim 29, wherein said widening means for widening the straight winding legs includes a pressing band.

49. An arrangement as defined in claim 29, and further comprising heating means arranged for heating the windings and being in operative connection with said widening means for widening the straight winding legs.

50. An arrangement as defined in claim 29, wherein said widening means for widening the straight winding legs includes a heat coulisse.

51. An arrangement as defined in claim 29; and further comprising cooling means arranged behind said widening means for winding the straight winding legs.

52. An arrangement as defined in claim 51, wherein said cooling means includes a blowing pipe for supplying cold air.

53. An arrangement as defined in claim 19, wherein said flattening and widening means is located at the same location as said separating and transporting means as considered in a transporting direction, and between said separating and transporting means as considered in a direction which is transverse to the transporting direction.

54. An arrangement as defined in claim 19, wherein said flattening and widening means operates independently of said winding means.

* * * * *